US005746906A

United States Patent [19]

McHenry et al.

[11] Patent Number: 5,746,906

[45] Date of Patent: May 5, 1998

[54] COAL TAR PITCH BLEND HAVING LOW POLYCYCLIC AROMATIC HYDROCARBON CONTENT AND METHOD OF MAKING THEREOF

[75] Inventors: E. Ronald McHenry, Berea, Ohio; William E. Saver, Natrona Heights, Pa.

[73] Assignee: Koppers Industries, Inc., Pittsburgh, Pa.

[21] Appl. No.: 513,329

[22] Filed: Aug. 10, 1995

[51] Int. Cl.[6] ..... C10C 73/36

[52] U.S. Cl. ..... 208/22; 208/23; 208/39; 208/41; 208/42; 208/44

[58] Field of Search ..... 208/22, 23, 39, 208/41, 42, 44

[56] References Cited

U.S. PATENT DOCUMENTS 5,262,043 11/1993 Boenigk et al. .

OTHER PUBLICATIONS

A.A. Mirtchi & L. Noel, "Polycyclic Aromatic Hydrocarbons (PAH) in Pitches used in the Aluminum Industry," Carbon '94 Extended Abstracts 1994.

E.R. McHenry, "Industrial Pitch Quality of the Future," Proceedings of the Fourth Australasian Aluminum Smelter Technology Workshop, Sydney, Australia, Oct. 25–30, 1992.

Pitch, Coal tar–petroleum (TSCA,NDSL ELXEC) Jun. 1995 TSCA.

*Primary Examiner*—Helane Myers

*Attorney, Agent, or Firm*—Barry I. Friedman; Dickie, McCamey & Chilcote, P.C.

[57] ABSTRACT

A coal tar pitch/petroleum pitch blend is disclosed together with a method of making the same. In accordance with the invention, a crude coal tar material is selected according to specific properties including QI, specific gravity, water and ash content. A petroleum pitch material is also selected according to its softening point, QI, coking value and sulfur content. The coal tar pitch is distilled to a uncharacteristically high softening point which is then mixed with the petroleum pitch to a desired softening end point. The material retains significant QI and coking value characteristics of pure coal tar pitch particularly for use in Soderberg-type anodes for aluminum smelting as well as electric arc furnace electrodes. PAH emissions, and more specifically B(a)P equivalent emissions, are all reduced by approximately 40%.

71 Claims, No Drawings

COAL TAR PITCH BLEND HAVING LOW POLYCYCLIC AROMATIC HYDROCARBON CONTENT AND METHOD OF MAKING THEREOF

BACKGROUND OF THE INVENTION

1. Field of the Invention

The present invention relates to a coal tar pitch product which is suitable for utilization in the manufacture of anodes for aluminum smelting and electric arc furnaces. More specifically, the invention relates to a blend of coal tar pitch and petroleum pitch which provides equivalent performance to current coal tar pitch materials and which provides a minimum of 40% reduction of polycyclic aromatic hydrocarbons or PAH's in the total pitch matrix. The present invention further relates to a method of making the pitch blend.

2. Description of the Prior Art

Coal tar is a primary by-product material produced during the destructive distillation or carbonization of coal into coke. While the coke product is utilized as a fuel and reagent source in the steel industry, the coal tar material is distilled into a series of fractions, each of which are commercially viable products in their own right. A significant portion of the distilled coal tar material is the pitch residue. This material is utilized in the production of anodes for aluminum smelting, as well as electrodes for electric arc furnaces used in the steel industry. In evaluating the qualitative characteristics of the pitch material, the prior art has been primarily focused on the ability of the coal tar pitch material to provide a suitable binder used in the anode and electrode production processes. Various characteristics such as softening point, specific gravity, quinoline insolubility percentage and coking value have all served to characterize coal tar pitches for applicability in these various manufacturing processes and industries.

In light of increasing environmental limitations on emissions from manufacturing facilities which produce and utilize the anode materials, most specifically in the aluminum industry, other considerations with regard to the selection and utilization of coal tar pitches have risen in importance.

Mirtchi and Noël, in a paper presented at Carbon '94 at Granada, Spain, entitled "Polycyclic Aromatic Hydrocarbons in Pitches Used in the Aluminum Industry," described and categorized the PAH content of coal tar pitches. These materials were classified according to their carcinogenic or mutagenic effect on living organisms. The paper identified 14 PAH materials which are considered by the United States Environmental Protection Agency to be potentially harmful to public health. Each of the 14 materials is assigned a relative ranking of carcinogenic potency which is based on a standard arbitrary assignment of a factor of 1 to Benzo(a) pyrene or B(a)P. Estimations of potential toxicity of a pitch material may be made by converting its total PAH content into a B(a)P equivalent which eliminates the necessity of referring to each of the 14 materials individually, providing a useful shorthand for the evaluation of a material's toxicity.

A typical coal tar binder pitch is characterized as shown in Table I.

TABLE I

| | |
|---|---|
| Softening Point °C. | 111.3 |
| Toluene Insoluble, % | 28.1 |
| Quinoline Insoluble, % | 11.9 |
| Coking Value, Modified Conradson, % | 55.7 |
| Ash, % | 0.21 |
| Specific Gravity, 25/15° C. | 1.33 |

TABLE I-continued

| | |
|---|---|
| Sulfur, % | 0.6 |
| B(a)P Equivalent, ppm | 27,500 |

Two shortcomings with respect to the use of coal tar pitch in general, and more specifically in the aluminum industry, have recently emerged. The first is a heightened sensitivity to the environmental impact of this material and its utilization in aluminum smelting anodes. The other is a declining supply of crude coal tar from the coke-making process. Significant reductions in coke consumption, based upon a variety of factors, has reduced the availability of crude coal tar. This reduction in production of these raw materials is expected to escalate in the near future and alternative sources and substitute products have been sought for some period. No commercially attractive substitute for coal tar pitch in the aluminum industry has been developed, however.

Several attempts have been made to develop alternative materials or blends as substitutes for the coal tar pitch material. These efforts have been directed, however, at the extending of coal tar pitches to more effectively utilize diminished crude coal tar supplies. None of these previous efforts have been specifically directed to the reduction of PAH materials. Consistent with these efforts, it is well known to blend a small amount of petroleum pitch material having a softening point of 80° C. to a coal tar pitch material with minimal deleterious impact on the performance of the resultant blend for use in aluminum anode production. The petroleum pitch material is blended with the coal tar pitch material in a ratio of 10:90 with the 10% petroleum pitch material extending the volume of coal tar pitch by a factor of 10% with no significant loss of performance of the final blend. These 90:10 blends have been utilized for several years in the industry and present the only applicable use of petroleum pitch in this process. As the petroleum pitch material does not constitute a significant fraction of the final blended material, the PAH emission of the resulting material is not significantly changed from the undiluted coal tar pitch.

Boenigk et al., U.S. Pat. No. 5,262,043, issued Nov. 16, 1993, entitled "Coal Tar Pitch and the Preparation and Use Thereof," discloses a coal tar pitch having a significant reduction in B(a)P content. The reference teaches that the object of the invention is to prepare a coal tar pitch which has an optical anisotrophy below 2% and contains a lower amount of carcinogenic agents than unadulterated coal tar pitch. More specifically, a B(a)P content of less than 50 ppm under laboratory conditions is disclosed and taught. The reference specifically refers to any material having more than 140 ppm of B(a)P is a dangerous material and teaches away from its production. The reference discloses a pitch obtained from a residue of the primary distillation of coal tar. The initial pitch starting material is characterized by a softening point of 89° C., a TI value of 24.1%, a QI value of 5.8%, a coking residue of 51.4%, and a B(a)P content of 1.1%. An intermediate material is obtained by distilling the material in an evaporator at a temperature in the range of 300°–380° C. at a pressure below 1 mbar and a contact period of the residue between 2 and 10 minutes. The evaporator has a specific evaporating surface of between 330 and 10,000 $m^2/m^3$. A coal tar pitch it thus produced having a TI value of 50.5%, a QI value of 10.2%, and a B(a)P content of 35 ppm was thus obtained. This material was then dissolved in anthracene oil in a 72:28 ratio to obtain an electrode-binding agent. The electrode-binding agent had a softening point of 111.5° C., a QI of 7.7, and a B(a)P of 40 ppm.

SUMMARY OF THE INVENTION

A coal tar pitch petroleum pitch blend is disclosed which enjoys substitutable performance characteristics for coal tar pitch alone for use in commercial aluminum and electric arc furnace steel production. The resultant material comprises a softening point of approximately 110° C. with a QI percentage of approximately 12, while reducing B(a)P equivalents from 27,500 to 15,300 with an actual B(a)P concentration of from 1,500 to 6,000 ppm. The material is produced by a process which involves the selection of petroleum pitch material having specific pre-selected characteristics and which has an approximate softening point of 80° C. This material is then blended with a coal tar pitch material which has been distilled to a softening point from approximately 130° C. to 175° C. in a ratio of approximately 60:40 coal tar pitch to petroleum pitch. The material is also optionally intended to contain a sulfur concentration of less than 1%.

These and other advantages and features of the present invention will be more fully understood with reference to the presently preferred embodiments thereof.

DESCRIPTION OF THE PREFERRED EMBODIMENTS

An improved coal tar pitch blend is disclosed which is primarily intended for use in production of anode materials. The anodes thus produced are particularly intended for use in the Soderberg process for the smelting of aluminum. The coal tar pitch blend material may also be utilized in the production of anodes for use in the prebake process for aluminum and electrodes for electric arc furnaces. The blended pitch material is specifically intended to reduce the production of PAH's during the use of anodes produced therewith.

The blended material is produced by combining coal tar pitch, which is characterized by a high PAH content, with petroleum pitch, which is typically characterized as having a low PAH content. Mere dilution of the coal tar pitch with the petroleum pitch material is ineffective, however, as the petroleum pitch significantly lacks certain characteristics of coal tar pitch which makes the coal tar pitch useful as a binding material. More specifically, the petroleum pitch lacks a significant percentage of quinoline insolubles, or QI, which are necessary for the binder process. More particularly, it has been found that blending of up to 15% of petroleum pitch without any additional processing yields a serviceable material yet achieves minimal reduction in PAH's. It is critical to produce a final material which is adapted to produce the same strength and bakability as existing coal tar pitch binder material. Test results have indicated that high percentages of petroleum pitch material utilized in the final blend, e.g., more than 15%, result in poor performance and inconsistent electrode characteristics.

It has been discovered that in addition to utilization of the petroleum pitch material having characteristic low PAH content, it is necessary to first reduce the PAH content of the coal tar pitch intermediate material which is utilized in the blend. Coal tar pitch is typically distilled to an approximately 110° C. softening point. The softening point is the basic measurement utilized to determine the distillation process end point in coal tar pitch production and to establish the mixing, forming or impregnating temperatures in carbon production. All softening points referred to herein are taken according to the Mettler method or ASTM Standard D3104. Additional characteristics described herein include quinoline insolubility which is utilized to determine the quantity of solid and high molecular weight material in the pitch. QI may also be referred to as α-resin and the standard test methodology used to determine the QI as a weight percentage include either ASTM Standard D4746 or ASTM Standard D2318. Toluene insolubility, or TI, will also be referred to herein, and is determined through ASTM Standard D4072 or D4312.

In principle, the highest possible carbon yield for a pitch binder or impregnant will maximize product density and strength. Laboratory coking values can be used as a screening test or quality control tool for this important characteristic. However, in actual practice, the in situ binder or impregnant coke yield is the most relative parameter. The Modified Conradson methodology, as specified by ASTM D2416, is utilized throughout this reference.

High ash content in pitch is undesirable since the ash does not contribute to carbon yield and can cause problems in processing and carbon performance. ASTM Standard D2415 has been utilized to determine the ash content of these materials.

The atomic carbon to hydrogen ratio is calculated from the results of combustion analysis for carbon and hydrogen. The aromaticity index, however, is determined by infrared spectroscopy in the region of 2.5 to 4.5 microns, and by nuclear magnetic resonance, or NMR. The aromaticity index is calculated as a ratio of aromatic hydrocarbons to non-aromatic hydrocarbons. The aromaticity of the pitch material plays an important, but as yet not well-understood role, in predicting the final characteristics of the material. Generally, aromaticity correlates closely with the QI content of coal tars and pitches. Since QI is almost completely converted to coke upon carbonization, it generally adds to the higher coke yields obtained from pitches with higher aromaticity. Aromaticity also correlates with the thermal reactivity of tars and pitches as measured by the rate of gas evolution upon heating. Low aromaticity is associated with higher gas rate and with more rapid changes upon exposure to high temperatures. Typical coal tar pitch binder in North America has QI content of approximately 10–15%. Internationally, QI levels range from approximately 2–20%. Typical petroleum pitch, however, has no QI, which presents a significant hurdle in the adaptation of petroleum pitch in a coal tar pitch system. Conversely, coal tar pitch has a B(a)P equivalent of approximately 27,500 ppm, while a typical petroleum pitch has an equivalent level of approximately 8,000 ppm.

The first step in the manufacture of the coal tar pitch/petroleum pitch blend is the selection of particular crude coal tars according to the specific parameters in Table II.

TABLE II

| | Applicable Range | Preferred Range |
|---|---|---|
| QI, % | 1–20 | 5–10 |
| Specific Gravity, 25/15° C. | 1.18–1.38 | 1.20–1.25 |
| $H_2O$, % | 0–10 | <2 |
| Ash, % | 0.01–0.23 | <0.1 |
| Aromaticity, % | 3.5–12.9 | — |
| Paraffinic Content, % | 0.2–6.0% | ≦2 |
| Sulfur, % | 0.48–0.77 | ≦0.6 |

The crude coal tar material is distilled utilizing conventional techniques and standard procedures in either a continuous or a batch process to produce a coal tar pitch material. Typically, coal tar pitches have a softening point of approximately 110° C. The coal tar pitch utilized in the present invention is distilled to a softening point of 130°–175° C., with a preferred end point of 140° C. During the distillation of the coal tar pitch material, measurements are taken on a regular basis and the end point of the distillation is calculated based upon the desired softening point. Furthermore, it is specifically desired that the end points given in Table III should be targeted for the coal tar pitch material.

TABLE III

| | |
|---|---|
| QI, % | 14 ± 4 |
| Coking Value, Modified Conradson, % | 57 ± 2 |
| Sulfur, % | 0.55 ± 0.05 |

A petroleum pitch material is then selected for blending with the coal tar pitch material described above according to several characteristics, including the softening point which is the primary selection characteristic. A petroleum pitch having a softening point of 80° C., nominal, is utilized in the process. The following Table IV lists the primary characteristics necessary for the selection.

TABLE IV

| | |
|---|---|
| Softening Point, °C. | 80 ± 5 |
| QI, % | 0 |
| TI, % | 1–2 |
| Coking Value, Modified Conradson, % | 35–40 |
| Sulfur, % | 1 + 1.8,–0.4 |

The coal tar pitch is distilled at a bottom of the column temperature in the range of 720°–730° F. with a target temperature of 727° F. The feed rate of the still is approximately 65 gpm and the pressure at the top of the still is approximately 150 mm of mercury. At the completion of the distillation cycle, the material is flashed at 40±5 mm of mercury. The final residue is intended to have a softening point of approximately 140°–142° C. The estimated maximum softening point is 150° C. with conventional equipment In practice, the petroleum pitch material is placed in a storage tank at approximately 380° F. The coal tar pitch residue is transferred into the storage tank directly from the still at a temperature of approximately 550° F. The nominal temperature of the residue is approximately 600° F. at the time that it leaves the still. Hourly line and tank samples are taken during the mixing process and the coal tar pitch residue is added until the end point parameters are reached. The tank may be agitated in any conventional fashion.

It should be specifically noted that the softening point of the material will rise slightly as the blended pitch is stored in the tank at a temperature above 400° F. Approximately 1° C. of softening point is added for every 24 hours that the heated material remains in a storage tank which utilizes a vacuum vapor recovery system.

The blended material is distilled and mixed such that the end point characteristics shown in the following Table V may be reached.

TABLE V

| | | |
|---|---|---|
| Softening Point, °C. | 110.6 ± 3 | |
| TI, % | 24.0 ± 2 | |
| QI, % | 12.1 ± 2 | |
| Coking Value, Modified Conradson, % | 56 | Min. |
| Sulfur Concentration, % | .73, ≦1.0 | Max. |
| B(a)P, ppm | ≦5,500 | |
| B(a)P Equivalents, ppm | ≦15,300 | |

As can be seen from the foregoing Table V, this blend presents a coal tar pitch substitute which enjoys an acceptable QI percentage, a workable softening point, and a 44% reduction in B(a)P equivalent.

EXAMPLES

Further details of the present invention are shown in the following examples:

Example 1

Crude tar having a QI of 8.4%, a water content of 0.8%, and an ash content of 0.07% is distilled at a beginning softening point of 137.5° C. and is distilled over a 13 hour period with the softening point ranging from 137.1 to 143.7° C. The material is added to a storage tank containing 13,281 gallons of petroleum pitch having a softening point of 81.7° C. Samples taken between the 4th and 13th hour of mixing at the tank begin at a softening point of 97.2° C. with a final end point of 113.1° C. A laboratory analysis of the final material is summarized in the following Table VI:

TABLE VI

| | |
|---|---|
| Softening Point, °C. | 112 |
| Specific Gravity, 25/15° C. | 1.30 |
| TI, % | 23.1 |
| QI, % | 10.7 |
| β-Resin, % | 12.4 |
| Coking Value, Modified Conradson, % | 56.7 |
| Ash, % | 0.11 |
| Sulfur, % | 0.88 |
| B(a)P Equivalent | 15,064 |

Example 2

Crude tar material having a QI of 9.8%, a water content of 0.7%, an ash content of 0.21%, a specific gravity at 15.5° C. of 1.24, and a sulfur content of 0.59% is distilled over an 11¼ hour time period with a beginning softening point of 140.7° C. During the distillation process, the softening point of the residue fluctuated between 138.1° and 147.8° C. The residue was added to a storage tank containing 15,058 gallons of petroleum pitch material having a specific gravity at 15.5° C. of 1.186, a sulfur content of 1.14%, a softening point of 79.9° C., and a coking value of 42.8%. Softening point tank samples were taken starting from the first hour of mixing and began at 82.3° C., with a final value of 111.4° C. Final chemical analysis of the second batch of material is summarized in the following Table VII:

TABLE VII

| | |
|---|---|
| Softening Point, °C. | 110.6 |
| Specific Gravity, 25/15° C. | 1.3 |
| TI, % | 24.0 |
| QI, % | 11.9 |
| β-Resin, % | 12.1 |
| Coking Value, Modified Conradson, % | 57.7 |
| Ash, % | 0.25 |
| Sulfur, % | 0.82 |
| B(a)P Equivalents, ppm | 15,570 |

While a present preferred embodiment of the invention is described, it is to be distinctly understood that the invention is not limited thereto but may be otherwise embodied and practiced within the scope of the following claims.

What is claimed is:

1. A blended binder pitch material, comprising:

a) a coal tar pitch base, said coal tar pitch having a softening point in the range of 130 degrees Celsius to 175 degrees Celsius; and b) a petroleum pitch component having a softening point in the range of 75 degrees Celsius to 85 degrees Celsius;

whereby, the resultant blended binder pitch material has a softening point in the range of 107 degrees Celsius to 114 degrees Celsius and further achieves a 40 percent reduction in benzo(a)pyrene equivalents as compared to unadulterated coal tar pitch having a softening point within the range of 107 degrees Celsius to 114 degrees Celsius.

2. A blended binder pitch material as described and claimed in claim 1, wherein said material is substitutable for unadulterated coal tar pitch.

3. A blended binder pitch material as described and claimed in claim 1, wherein said material is adaptable for use as binder for the production of at least one of anodes for commercial aluminum production and electrodes for electric arc furnace steel production.

4. A blended binder pitch material as described and claimed in claim 3, wherein said material is adaptable for use as binder for the production of anodes for commercial aluminum production utilizing the Soderberg process.

5. A blended binder pitch material as described and claimed in claim 3, wherein said material is adaptable for use as binder for the production of anodes for commercial aluminum production utilizing the prebake process.

6. A blended binder pitch material as described and claimed in claim 1, wherein said material further comprises a softening point of approximately 110 degrees Celsius.

7. A blended binder pitch material as described and claimed in claim 6, wherein said material further comprises a softening point of 110.6 degrees Celsius.

8. A blended binder pitch material as described and claimed in claim 6, wherein said material further comprises a softening point of 112 degrees Celsius.

9. A blended binder pitch material as described and claimed in claim 1, wherein said material further comprises a specific gravity of 1.3 at 25/15 degrees Celsius.

10. A blended binder pitch material as described and claimed in claim 1, wherein said material further comprises a QI percentage within the range of 10 to 15 percent.

11. A blended binder pitch material as described and claimed in claim 10, wherein said material further comprises a QI percentage of 12.1 percent.

12. A blended binder pitch material as described and claimed in claim 10, wherein said material further comprises a QI percentage of 11.9 percent.

13. A blended binder pitch material as described and claimed in claim 10, wherein said material further comprises a QI percentage of 10.7 percent.

14. A blended binder pitch material as described and claimed in claim 1, wherein said material further comprises a TI percentage within the range of 22 to 26 percent.

15. A blended binder pitch material as described and claimed in claim 14, wherein said material further comprises a TI percentage of 24.0 percent.

16. A blended binder pitch material as described and claimed in claim 14, wherein said material further comprises a TI percentage of 23.1 percent.

17. A blended binder pitch material as described and claimed in claim 1, wherein said material further comprises a coking value of at least 56 percent.

18. A blended binder pitch material as described and claimed in claim 1, wherein said material further comprises a sulfur concentration of less than 1 percent.

19. A blended binder pitch material as described and claimed in claim 18, wherein said material further comprises a sulfur concentration of 0.73 percent.

20. A blended binder pitch material as described and claimed in claim 18, wherein said material further comprises a sulfur concentration of 0.88 percent.

21. A blended binder pitch material as described and claimed in claim 1, wherein said material achieves an approximate reduction in benzo(a)pyrene equivalents from 27,500 ppm for unadulterated coal tar pitch to 15,300 ppm.

22. A blended binder pitch material as described and claimed in claim 1, wherein said material further comprises a benzo(a)pyrene concentration within the range of 1,500 to 6,000 ppm.

23. A blended binder pitch material as described and claimed in claim 22, wherein said material further comprises a benzo(a)pyrene concentration of 5,500 ppm.

24. A blended binder pitch material as described and claimed in claim 1, wherein said material is at least 15 percent, by weight, of said petroleum pitch component.

25. A blended binder pitch material as described and claimed in claim 24, wherein said material is approximately 60 percent, by weight, coal tar pitch base and 40 percent, by weight, petroleum pitch component.

26. A method of making a blended binder pitch material comprising a coal tar pitch base and a petroleum pitch component, said method comprising the steps of:

a) distilling a coal tar pitch base material to a softening point in the range of 130 degrees Celsius to 175 degrees Celsius;

b) mixing said coal tar pitch base material with a petroleum pitch component having a softening point in the range of 75 degrees Celsius to 85 degrees Celsius; and c) terminating said mixing step when the resultant blended binder pitch material has a softening point in the range of 107 degrees Celsius to 114 degrees Celsius and further achieves a 40 percent reduction in benzo (a)pyrene equivalents as compared to unadulterated coal tar pitch having a softening point within the range of 107 degrees Celsius to 114 degrees Celsius.

27. A method of making a blended binder pitch material as described and claimed in claim 26, wherein said coal tar pitch base material is distilled from a crude coal tar.

28. A method of making a blended binder pitch material as described and claimed in claim 27, wherein said crude coal tar further comprises a QI percentage in the range of 1 to 20 percent.

29. A method of making a blended binder pitch material as described and claimed in claim 28, wherein said crude coal tar further comprises a QI percentage in the range of 5 to 10 percent.

30. A method of making a blended binder pitch material as described and claimed in claim 27, wherein said crude coal tar further comprises a specific gravity in the range of 1.18 to 1.38 percent at 25/15 degrees Celsius.

31. A method of making a blended binder pitch material as described and claimed in claim 30, wherein said crude coal tar further comprises a specific gravity in the range of 1.20 to 1.25 percent at 25/15 degrees Celsius.

32. A method of making a blended binder pitch material as described and claimed in claim 27, wherein said crude coal tar further comprises a water concentration in the range of 0 to 10 percent.

33. A method of making a blended binder pitch material as described and claimed in claim 32, wherein said crude coal tar further comprises a water concentration of less than 2 percent.

34. A method of making a blended binder pitch material as described and claimed in claim 27, wherein said crude coal tar further comprises an ash content in the range of 0.01 to 0.23 percent.

35. A method of making a blended binder pitch material as described and claimed in claim 34, wherein said crude coal tar further comprises an ash content of less than 0.1 percent.

36. A method of making a blended binder pitch material as described and claimed in claim 27, wherein said crude coal tar further comprises an aromaticity content in the range of 3.5 to 12.9 percent.

37. A method of making a blended binder pitch material as described and claimed in claim 27, wherein said crude coal tar further comprises a paraffinic content in the range of 0.2 to 6.0 percent.

38. A method of making a blended binder pitch material as described and claimed in claim 37, wherein said crude coal tar further comprises a paraffinic content of less than 2 percent.

39. A method of making a blended binder pitch material as described and claimed in claim 27, wherein said crude coal tar further comprises a sulfur content in the range of 0.48 to 0.77 percent.

40. A method of making a blended binder pitch material as described and claimed in claim 39, wherein said crude coal tar further comprises a sulfur content of less than or equal to 0.6 percent.

41. A method of making a blended binder pitch material as described and claimed in claim 26, wherein said coal tar pitch base material is distilled to a softening point of approximately 140 degrees Celsius.

42. A method of making a blended binder pitch material as described and claimed in claim 26, further comprising the additional step of adjusting said softening point of said coal tar pitch base material during said distillation step.

43. A method of making a blended binder pitch material as described and claimed in claim 42, wherein said softening point of said coal tar pitch base material is adjusted within the range of 137.1 to 143.7 degrees Celsius.

44. A method of making a blended binder pitch material as described and claimed in claim 42, wherein said softening point of said coal tar pitch base material is adjusted within the range of 138.1 and 147.8 degrees Celsius.

45. A method of making a blended binder pitch material as described and claimed in claim 26, further comprising the additional step of monitoring the softening point of the coal tar pitch base material during distillation.

46. A method of making a blended binder pitch material as described and claimed in claim 45, wherein a final softening point target is calculated from said monitoring of said softening point of the coal tar pitch base during distillation.

47. A method of making a blended binder pitch material as described and claimed in claim 26, wherein said coal tar pitch base is distilled to a QI percentage in the range of 12 to 16 percent.

48. A method of making a blended binder pitch material as described and claimed in claim 47, wherein said coal tar pitch base material is distilled to a QI percentage of 14 percent.

49. A method of making a blended binder pitch material as described and claimed in claim 26, wherein said coal tar pitch base material is distilled to a coking value percentage in the range of 55 to 59 percent.

50. A method of making a blended binder pitch material as described and claimed in claim 49, wherein said coal tar pitch base material is distilled to a coking value percentage of 57 percent.

51. A method of making a blended binder pitch material as described and claimed in claim 26, wherein said coal tar pitch base material is distilled to a sulfur concentration in the range of 0.55 to 0.60 percent.

52. A method of making a blended binder pitch material as described and claimed in claim 51, wherein said coal tar pitch base is distilled to a sulfur concentration percentage of 0.55 percent.

53. A method of making a blended binder pitch material as described and claimed in claim 26, wherein said petroleum pitch component further comprises a softening point of 80 degrees Celsius.

54. A method of making a blended binder pitch material as described and claimed in claim 26, wherein said petroleum pitch component further comprises a TI percentage in the range of 1 to 2 percent.

55. A method of making a blended binder pitch material as described and claimed in claim 26, wherein said petroleum pitch component further comprises a coking value in the range of 35 to 40 percent.

56. A method of making a blended binder pitch material as described and claimed in claim 26, wherein said petroleum pitch component further comprises a sulfur concentration in the range of 0.6 to 2.8 percent.

57. A method of making a blended binder pitch material as described and claimed in claim 56, wherein said petroleum pitch component further comprises a sulfur concentration of 1 percent.

58. A method of making a blended binder pitch material as described and claimed in claim 26, wherein said crude coal tar is distilled at a bottom temperature in the range of 720 to 730 degrees Fahrenheit.

59. A method of making a blended binder pitch material as described and claimed in claim 58, wherein said crude coal tar is distilled at a bottom temperature of 727 degrees Fahrenheit.

60. A method of making a blended binder pitch material as described and claimed in claim 26, wherein the distillation step further comprises a feed rate of the still of approximately 65 gallons per minute.

61. A method of making a blended binder pitch material as described and claimed in claim 26, wherein the distillation step further comprises a pressure at the top of the still of approximately 150 millimeters of mercury.

62. A method of making a blended binder pitch material as described and claimed in claim 26, further comprising the additional step of flashing the residue in a vacuum within the range of 35 to 45 millimeters of mercury.

63. A method of making a blended binder pitch material as described and claimed in claim 62 wherein said flashing occurs at 40 millimeters of mercury.

64. A method of making a blended binder pitch material as described and claimed in claim 26, further comprising the step of placing said petroleum pitch component within a storage tank for mixing with the coal tar pitch base material.

65. A method of making a blended binder pitch material as described and claimed in claim 64, further comprising the step of placing said petroleum pitch component within said storage tank at a temperature of approximately 380 degrees Fahrenheit.

66. A method of making a blended binder pitch material as described and claimed in claim 26, further comprising the step of adding the coal tar pitch base material to the storage tank containing the petroleum pitch component.

67. A method of making a blended binder pitch material as described and claimed in claim 66, wherein said coal tar pitch base material is at a temperature of approximately 600 degrees Fahrenheit at the termination point of the still.

68. A method of making a blended binder pitch material as described and claimed in claim 66, wherein said coal tar pitch base material is at a temperature of approximately 550 degrees Fahrenheit as it is placed in said storage tank.

69. A method of making a blended binder pitch material as described and claimed in claim 26, further comprising the additional step of monitoring line and tank samples during the mixing process until the end point parameters are reached.

70. A method of making a blended binder pitch material as described and claimed in claim 26, further comprising the step of agitating the tank during the mixing step.

71. A blended binder pitch material is manufactured according to the steps comprising:

a) distilling a coal tar pitch base material to a softening point in the range of 130 degrees Celsius to 175 degrees Celsius;

b) mixing said coal tar pitch base material with a petroleum pitch component having a softening point in the range of 75 degrees Celsius to 85 degrees Celsius; and c) terminating said mixing step when the resultant blended binder pitch material has a softening point in the range of 107 degrees Celsius to 114 degrees Celsius and further achieves a 40 percent reduction in benzo (a)pyrene equivalents as compared to unadulterated coal tar pitch having a softening point within the range of 107 degrees Celsius to 114 degrees Celsius.

* * * * *

UNITED STATES PATENT AND TRADEMARK OFFICE

CERTIFICATE OF CORRECTION

PATENT NO. : 5,746,906

DATED : May 5, 1998

INVENTOR(S) : E. Ronald McHenry and William E. Saver

It is certified that error appears in the above-identified patent and that said Letters Patent is hereby corrected as shown below:

Column 2, line 58, delete "it" and insert -- is --.

Column 5, Table III, line 5, delete "0.55 ± 0.05" and insert -- 0.55 + 0.05 --.

Signed and Sealed this

Twenty-first Day of July, 1998

*Attest:*

BRUCE LEHMAN

*Attesting Officer*

*Commissioner of Patents and Trademarks*